US010422525B2

(12) United States Patent
Hagihara et al.

(10) Patent No.: US 10,422,525 B2
(45) Date of Patent: Sep. 24, 2019

(54) OXYGEN BURNER AND OPERATION METHOD FOR OXYGEN BURNER

(71) Applicant: TAIYO NIPPON SANSO CORPORATION, Tokyo (JP)

(72) Inventors: Yoshiyuki Hagihara, Kofu (JP); Naoki Seino, Kai (JP); Yasuyuki Yamamoto, Kofu (JP); Takayuki Matsumura, Kai (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 79 days.

(21) Appl. No.: 15/748,755

(22) PCT Filed: Sep. 13, 2016

(86) PCT No.: PCT/JP2016/076960

§ 371 (c)(1),
(2) Date: Jan. 30, 2018

(87) PCT Pub. No.: WO2017/047579

PCT Pub. Date: Mar. 23, 2017

(65) Prior Publication Data

US 2019/0024888 A1 Jan. 24, 2019

(30) Foreign Application Priority Data

Sep. 14, 2015 (JP) ..... 2015-180487

(51) Int. Cl.
*F23D 14/22* (2006.01)
*F23D 14/32* (2006.01)
(Continued)

(52) U.S. Cl.
CPC ..... *F23D 14/22* (2013.01); *F23D 14/32* (2013.01); *F23D 14/38* (2013.01); *F23D 14/48* (2013.01); *F23D 14/62* (2013.01)

(58) Field of Classification Search
CPC ..... F23D 14/22; F23D 14/32; F23D 14/38
(Continued)

(56) References Cited

U.S. PATENT DOCUMENTS 4,797,087 A 1/1989 Gitman
5,743,723 A 4/1998 Iatrides et al.
(Continued)

FOREIGN PATENT DOCUMENTS

CN 86 1 02828 12/1986
CN 101063524 10/2007
(Continued)

OTHER PUBLICATIONS

Office Action issued in CN Appln. No. 201680048545.7 dated Nov. 5, 2018 (w/ partial translation).
(Continued)

*Primary Examiner* — Gregory L Huson
*Assistant Examiner* — Nikhil P Mashruwala
(74) *Attorney, Agent, or Firm* — Nixon & Vanderhye P.C.

(57) ABSTRACT

One object of the present invention is to provide an oxygen burner which is capable of forming a high-velocity-oxygen jet flow without a cooling structure, and efficiently dissolving an object to be heated, and the present invention provides an oxygen burner comprising a primary oxygen ejection port provided at a tip of the primary oxygen flow path, a plurality of fuel gas supply pipes provided so as to branch a tip end side of the fuel gas flow path, a fuel gas ejection port provided in each of the fuel gas supply pipes, and a secondary oxygen ejection port provided at a tip of the secondary oxygen flow path, the fuel gas ejecting ports are arranged so as to surround the primary oxygen ejection port, the secondary oxygen ejection port is arranged so as to surround the fuel gas ejection ports and the primary oxygen ejection port, and the fuel gas ejection ports are arranged on
(Continued)

the same plane and protrude than a tip of the primary oxygen ejection port.

5 Claims, 4 Drawing Sheets

(51) Int. Cl.
*F23D 14/38* (2006.01)
*F23D 14/48* (2006.01)
*F23D 14/62* (2006.01)

(58) Field of Classification Search
USPC ..... 431/8, 354
See application file for complete search history.

(56) References Cited

U.S. PATENT DOCUMENTS 6,142,764 A 11/2000 Anderson et al.
6,604,937 B1 * 8/2003 Mahoney ..... C21C 5/5217 266/222
6,773,484 B2 * 8/2004 Mahoney ..... C21C 5/4606 266/225
7,707,833 B1 * 5/2010 Bland ..... F23R 3/286 60/737
8,272,859 B2 * 9/2012 Hagihara ..... B01J 2/02 425/6
8,915,731 B2 * 12/2014 Kang ..... F23C 9/006 110/205
9,447,969 B2 * 9/2016 Recourt ..... F23C 1/08
9,657,945 B2 * 5/2017 Gangoli ..... F27D 99/0033
2003/0108834 A1 * 6/2003 Pelton ..... F23D 14/22 431/8
2005/0000222 A1 * 1/2005 Inoue ..... F23R 3/10 60/776
2005/0239005 A1 * 10/2005 Lugnet ..... F23C 9/006 431/8
2008/0268387 A1 * 10/2008 Saito ..... F23R 3/286 431/8
2010/0167054 A1 * 7/2010 Hagihara ..... F23D 14/24 428/402
2013/0125798 A1 * 5/2013 Taylor ..... F23C 9/00 110/205

FOREIGN PATENT DOCUMENTS

CN 101294715 10/2008
CN 203177179 9/2013
GB 2 175 684 12/1986
JP 60-202225 10/1985
JP 7-248103 9/1995
JP 09-089224 4/1997
JP 09-166308 6/1997
JP 2001-141236 5/2001
JP 2002-267117 9/2002
JP 3577066 10/2004
JP 4050195 2/2008
JP 4261753 4/2009

OTHER PUBLICATIONS

International Search Report for PCT/JP2016/076960, dated Nov. 22, 2016, 4 pages.
Office Action for JP 2015-180487, dated Jan. 16, 2018, 6 pages (w/ translation).

* cited by examiner

OXYGEN BURNER AND OPERATION METHOD FOR OXYGEN BURNER

This application is the U.S. national phase of International Application No. PCT/JP2016/076960 filed 13 Sep. 2016, which designated the U.S. and claims priority to JP Patent Application No. 2015-180487 file 14 Sep. 2015, this entire contents of each of which are hereby incorporated by reference.

TECHNICAL FIELD

The present invention relates to an oxygen burner and an operation method for an oxygen burner.

BACKGROUND ART

Conventionally, a gaseous fuel-oxygen burner (hereinafter sometimes simply referred to as "oxygen burner") is widely used for heating and melting objects to be heated such as glass and iron scrap.

For example, a burner is widely known having a triple pipe structure in which an inner pipe for supplying a fuel gas is provided on the outer periphery of a center pipe for supplying primary oxygen and an outer pipe for supplying secondary oxygen is provided on the outer periphery of the inner pipe (For example, Patent Document 1).

In such an oxygen burner having a triple pipe structure, the fuel gas is burned by ejecting the oxygen gas (primary oxygen) from the center pipe, and using the secondary oxygen ejected from the outer pipe, and thereby flame is stabilized.

In addition, attempts have also been made to suppress a speed reduction of high-velocity-oxygen gas flow and efficiently dissolve an object to be heated away from the tip of the burner by ejecting a high-velocity-oxygen gas (primary oxygen) flow from the center pipe and accompanying the fuel with the high-velocity-oxygen gas flow, and thereby forming a flame around the high-velocity-oxygen gas flow (For example, Patent Documents 2 and 3).

For example, the structure of the oxygen burner disclosed in Patent Document 1 can be used without cooling the burner body because the heat load on the burner nozzle is small.

In addition, the structure of the oxygen bumer disclosed in Patent Documents 2 and 3 is an effective means for dissolving iron scrap, because it enables high-velocity-oxygen jet flow to reach far.

PRIOR ART DOCUMENT

Patent Document

[Patent Document 1] Japanese Patent (Granted) Publication No. 4261753

[Patent Document 2] Japanese Patent (Granted) Publication No. 4050195

[Patent Document 3] Japanese Patent (Granted) Publication No. 3577066

DISCLOSURE OF THE INVENTION

Problems to be Solved by the Invention

However, although the oxygen burner disclosed in Patent Document 1 is suitable for heating an object to be heated by radiant heat of the flame, since there is no cooling function of the burner nozzle, it is difficult to rapidly mix the fuel and oxygen. For this reason, the velocity of the combustion gas becomes slow, which is unsuitable for directly heating and melting the object to be heated.

In addition, the oxygen burner disclosed in Patent Documents 2 and 3 is superior in performance of melting an object to be heated by using a high-velocity-oxygen jet flow. However, since the fuel and oxygen are mixed inside the burner nozzle, it is necessary to cool the nozzle portion with a water-cooling jacket or the like.

The present invention has been made in view of the above circumstances, and an object of the present invention is to provide an oxygen burner which is capable of forming a high-velocity-oxygen jet flow without a cooling structure, and efficiently dissolving an object to be heated, and an operation method for the oxygen burner.

Means for Solving the Problem

In order to solve the above problems, the present invention provides the following oxygen burners and operation methods for an oxygen burner.

(1) An oxygen burner having a triple pipe structure in which a center pipe, an inner pipe on the outer side of the center pipe, and an outer pipe on the outer side of the inner pipe are concentrically arranged, and comprising a primary oxygen flow path formed inside the center pipe, a fuel gas flow path formed between the center pipe and the inner pipe, and a secondary flow path formed between the inner pipe and the outer pipe, wherein the oxygen burner comprises a primary oxygen ejection port provided at a tip of the primary oxygen flow path, a plurality of fuel gas supply pipes provided so as to branch a tip end side of the fuel gas flow path, a fuel gas ejection port provided in each of the fuel gas supply pipes, and a secondary oxygen ejection port provided at a tip of the secondary oxygen flow path, the fuel gas ejecting port is arranged so as to surround the primary oxygen ejection port, the secondary oxygen ejection port is arranged so as to surround the fuel gas ejection ports and the primary oxygen ejection port, and the fuel gas ejection ports are arranged on the same plane and protrude than a tip of the primary oxygen ejection port.

(2) An operation method for an oxygen burner, wherein the flow velocity of the primary oxygen ejected from the primary oxygen ejection port is higher than the flow velocity of the fuel gas ejected from the fuel gas ejection ports in the oxygen burner according to (1) above.

(3) The operation method for an oxygen burner according to (2) above, wherein the flow velocity of the fuel gas ejected from the fuel gas ejection ports is higher than the flow velocity of the secondary oxygen ejected from the secondary oxygen ejection port.

(4) The operation method for an oxygen burner according to (2) or (3), wherein a relationship between an oxygen flow rate A ejected from the primary oxygen ejection port, an oxygen flow rate B ejected from the secondary oxygen ejection port, and an oxygen flow rate C which is necessary for completely burning the fuel gas ejected from the fuel gas ejection ports is represented by the following formula (1):

$$C/(A+B) \leq 1 \quad (1).$$

Advantageous Effects of Invention

The oxygen burner according to the present invention is an oxygen burner having a triple pipe structure in which a center pipe, an inner pipe on the outer side of the center pipe, and an outer pipe on the outer side of the inner pipe are concentrically arranged, and comprising a primary oxygen flow path formed inside the center pipe, a fuel gas flow path formed between the center pipe and the inner pipe, and a secondary flow path formed between the inner pipe and the outer pipe, wherein the oxygen burner comprises a primary oxygen ejection port provided at a tip of the primary oxygen flow path, a plurality of fuel gas supply pipes provided so as to branch a tip end side of the fuel gas flow path; a fuel gas ejection port provided in each of the fuel gas supply pipes, and a secondary oxygen ejection port provided at a tip of the secondary oxygen flow path, the fuel gas ejecting port is arranged so as to surround the primary oxygen ejection port, the secondary oxygen ejection port is arranged so as to surround the fuel gas ejection ports and the primary oxygen ejection port, and each of the fuel gas ejection ports is arranged on the same plane and protrudes than a tip of the primary oxygen ejection port. Accordingly, a flame formed by the fuel gas and the secondary oxygen can be formed at a position away from the primary oxygen ejection port. As a result, it is possible to form a high-velocity-oxygen jet flow and efficiently dissolve the object to be heated, although the oxygen burner does not require a cooling structure.

In addition, in the operation method for an oxygen burner according to the present invention, the flow velocity of the primary oxygen ejected from the primary oxygen ejection port is higher than the flow velocity of the fuel gas ejected from the fuel gas ejection ports in the oxygen burner explained above. Accordingly, it is possible to form a high-velocity-oxygen jet flow and to melt the object to be heated efficiently while preventing the oxygen burner from being melted and damaged.

EMBODIMENTS OF THE INVENTION

Figure 1:
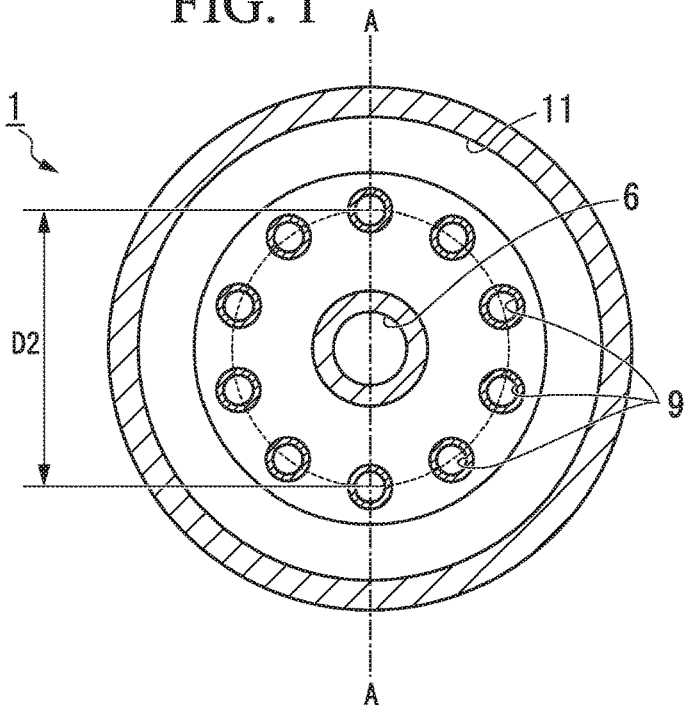
FIG. 1 is a front view showing a tip of an oxygen burner according to an embodiment of the present invention.

Hereinafter, an oxygen burner as an embodiment according to the present invention and an operation method for an oxygen burner using the oxygen burner will be described in detail. In the drawings used in the following description, for the sake of easy understanding of the features, there are cases where characteristic portions are shown enlarged for convenience, and it is not always that the dimensional ratio of each component is the same as the actual oxygen burner.

<Oxygen Burner>

Figure 2:
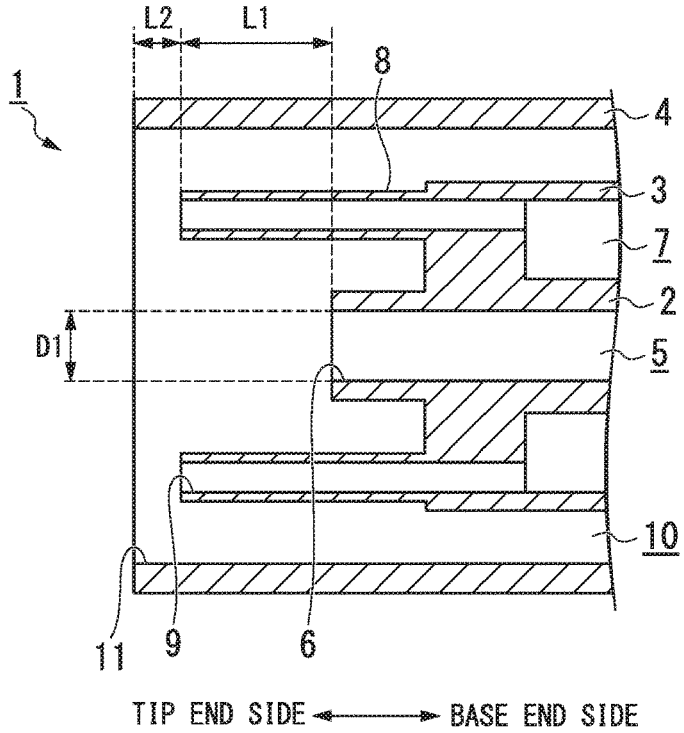
FIG. 2 is a schematic cross-sectional view taken along line A-A of the oxygen burner in FIG. 1.

First, the configuration of an oxygen burner which is one embodiment according to the present invention will be described. FIG. 1 is a front view of an oxygen burner 1 of the present embodiment. FIG. 2 is a schematic sectional view taken along the line A-A of the oxygen burner 1 of FIG. 1. As shown in FIG. 2, the oxygen burner 1 of the present embodiment is roughly configured to have a center pipe 2, an inner pipe 3, and an outer pipe 4. The oxygen burner 1 of the present embodiment has a triple pipe structure in which the center pipe 2, the inner pipe 3 provided on the outer side of the center pipe 2, and the outer pipe 4 provided on the outer side of the inner pipe 3 are arranged concentrically.

The oxygen burner 1 of the present embodiment has a structure that does not require a cooling structure, but forms a high-velocity-oxygen jet flow and can efficiently dissolve an object to be heated such as iron scrap.

As shown in FIG. 2, the center pipe 2 is provided at the center of the oxygen burner 1. The inside of the center pipe 2 has a straight pipe structure having substantially the same diameter, and forms a primary oxygen flow path 5. Primary oxygen is supplied from the base end side of the primary oxygen flow path 5. The primary oxygen passes through the inside of the primary oxygen flow path 5 and is ejected linearly from a primary oxygen ejection port 6 provided at the tip of the primary oxygen flow path 5.

The inner pipe 3 is provided outside the center pipe 2. A fuel gas flow path 7 is formed between the inner pipe 3 and the center pipe 2. A tip end side of the fuel gas flow path 7 is branched by a plurality of fuel gas supply pipes 8. Fuel gas is supplied from the base end side of the fuel gas flow path 7. The fuel gas flow passes through the fuel gas flow path 7 and is ejected from a plurality of fuel gas ejection ports 9 provided at the tip of each fuel gas supply pipe 8.

The fuel gas ejection ports 9 are arranged on the same plane. Further, this plane protrudes forward (in the flame ejection direction) from the tip of the center pipe 2 (primary oxygen ejection port 6). In addition, the fuel gas ejection ports 9 are arranged in a secondary oxygen flow path 10 and behind the secondary oxygen ejection port 11. As a result, the flame generated by the fuel gas ejected from the fuel gas ejection ports 9 and the secondary oxygen can be formed forward from the primary oxygen ejection port 6. As a result, it is possible to prevent the primary oxygen ejection port 6 from being melted and damaged by the flame formed so as to surround the primary oxygen ejection port 6.

The outer pipe 4 is provided outside the inner pipe 3. The secondary oxygen flow path 10 is formed between the outer pipe 4 and the inner pipe 3. Secondary oxygen is supplied from the base end side of the secondary oxygen flow path 10. The secondary oxygen passes through the secondary oxygen flow path 10 and is ejected from a secondary oxygen discharge port 11 provided at the tip of the secondary oxygen flow path 10.

The secondary oxygen ejection port 11 protrudes forward (in the flame ejection direction) from fuel gas ejection ports 9.

As shown in FIG. 1, fuel gas ejection ports 9 are arranged so as to surround the periphery of the primary oxygen ejection port 6. Further, the secondary oxygen ejection port 11 is arranged so as to surround the periphery of the fuel gas ejection ports 9 and the primary oxygen ejection port 6. As a result, the fuel gas ejected from fuel gas ejection ports 9 and the secondary oxygen ejected from the secondary oxygen ejection port 11 are mixed, and a flame is formed. In addition, there is a difference between the density of the gas in the region where the flame is formed and the density of the gas in the oxygen jet flow ejected from the primary oxygen ejection port 6. As a result, it is possible to suppress the attenuation of the velocity of the primary oxygen jet flow ejected from the primary oxygen ejection port 6.

Accordingly, since the velocity of the primary oxygen jet flow supplied from the center of the oxygen burner can be maintained, for example, when the oxygen burner is used in melting metal scrap, the primary oxygen jet flow can be caused to reach the position distant from the tip of the oxygen burner 1.

For example, when the oxygen burner 1 is used for auxiliary melting of an induction furnace or the like, it is possible to efficiently melt the lower part of the scrap filling layer by disposing the oxygen burner 1 of the present embodiment on the furnace lid. This makes it possible to shorten the dissolution time of the induction furnace and to reduce the electric power consumption rate.

In FIGS. 1 and 2, D1 is an inner diameter of the primary oxygen ejection port 6, D2 is a P.C.D. of the fuel gas spouting ports 9 (the distance between the centers of the fuel gas ejection ports 9). L1 is a distance between the fuel gas ejection ports 9 and the primary oxygen ejection port 6 in the center axis direction of the oxygen burner 1, and L2 is a distance between the secondary oxygen ejection port 11 and the fuel gas ejection ports 9 in the center axis direction of the oxygen burner 1.

In the relationship between D1 and L1, it is desirable that $0<L/D1\leq 5$. When L1/D1 is more than 5, the velocity attenuation of the primary oxygen jet flow ejecting from the primary oxygen ejection port 6 starts around the fuel gas ejection ports 9. When the velocity attenuation starts, the primary oxygen jet flow and the fuel gas jet flow ejected from the fuel gas jet 9 are readily mixed with each other, and the velocity attenuation of the primary oxygen jet flow further progresses. Accordingly, it is difficult to reach the primary oxygen jet flow to the position distant from the tip of the oxygen burner 1.

On the other hand, when L1/D1 is 0 (the fuel gas ejection ports 9 is at the same position as the primary oxygen ejection port 6 in the center axis direction of the oxygen burner 1) or the primary oxygen ejection port 6 protrudes toward the tip side of the oxygen burner 1 more than the fuel gas ejection ports 9, the primary oxygen ejection ports 6 may be too close to the fuel gas ejection ports 9, and there is a concern that the primary oxygen ejection port 6 may be overheated by the flame formed.

<Operation Method for Oxygen Burner>

Next, an operation method for an oxygen burner according to the present embodiment using the oxygen burner 1 described above will be described in detail. It is to be noted that various modifications can be made to the operation method for an oxygen burner of the present embodiment within the scope not departing from the gist of the present invention.

In the operation method for an oxygen burner of the present embodiment, the primary oxygen, the fuel gas, and the secondary oxygen are simultaneously ejected from the primary oxygen ejection port 6, the fuel gas ejection ports 9, and the secondary oxygen ejection port 11, respectively and whereby a flame is formed.

As the primary oxygen and the secondary oxygen, the purity of oxygen is arbitrary, and it is not particularly limited as long as it is an oxygen-containing gas. Specifically, for example, pure oxygen, oxygen-enriched gas having an oxygen concentration of 90% or more, and the like are preferable. In addition, as the fuel gas, LNG (liquefied natural gas), LPG (liquefied petroleum gas), butane gas and the like are preferable.

It is preferable that the flow velocity of the primary oxygen ejected from the primary oxygen ejection port 6 be higher than the flow velocity of the fuel gas ejected from the fuel gas ejection ports 9. As a result, the entraining effect of the fuel gas by the primary oxygen can be obtained, and a low-intensity flame can be formed.

It is also preferable that the flow velocity of the fuel gas ejected from the fuel gas ejection ports 9 be higher than the flow velocity of the secondary oxygen ejected from the secondary oxygen ejection port 11. As a result, the fuel gas ejected from the fuel gas ejection ports 9 forms a flame while accompanying the secondary oxygen, so that the cooling effect by the secondary oxygen can be obtained. As a result, the oxygen burner 1 of the present embodiment does not need to have a cooling structure like a water-cooling jacket.

Specifically, the flow velocity of the primary oxygen ejected from the primary oxygen ejection port 6 is preferably in the range of 50 to 340 m/s in terms of 0° C. and 1 atm. When the flow velocity is 50 m/s or more, the force accompanying the fuel gas ejected from the fuel gas ejection ports 9 becomes stronger, the primary oxygen can be sufficiently mixed with the fuel gas, and a low-intensity flame can be formed. In addition, when the flow velocity is 340 m/s or less, it is possible to suppress the pressure loss for ejecting the primary oxygen and to form a low-intensity flame and a non-luminous flame.

Specifically, the flow velocity of the secondary oxygen ejected from the secondary oxygen ejection port 11 is preferably in the range of 5 to 50 m/s in terms of 0° C. and 1 atm. When the flow velocity is 5 m/s or more, it is possible to prevent inconveniences such as winding due to a decrease in propulsion power of the flame. Further, when the flow velocity is 50 m/s or less, it is possible to prevent the secondary oxygen ejection port 11 from being melted and damaged.

The flow rate proportion between the primary oxygen and the secondary oxygen is not particularly limited. However, for example, the flow rate of the primary oxygen relative to the total flow rate of the primary oxygen and the secondary oxygen is preferably 10 to 70%. It is possible to suppress the proportion of the fuel gas which burns in the vicinity of the primary oxygen ejection port 6, and prevent the center pipe 2 and the inner pipe 3 from being melted and damaged by setting the proportion of the primary oxygen to 70% or less. In addition, it is possible to sufficiently mix the center portion of the fuel gas flow and oxygen, and form a non-luminous flame or a low-intensity flame by setting the proportion of the primary oxygen to 10% or more.

The relationship between the oxygen flow rate A ejected from the primary oxygen jetting port 6, the oxygen flow rate B ejected from the secondary oxygen jetting port 11, and the oxygen flow rate C which is necessary for completely combusting the fuel gas ejected from the fuel gas ejection ports 9 is preferably represented by the following formula (1):

$$C/(A+B)\leq 1 \quad (1).$$

When A, B, and C satisfy the relationship (1), since the flame formed by mixing the secondary oxygen ejected from the secondary oxygen ejection port 11 and the fuel gas ejected from the fuel gas ejection ports 9 is incompletely combusted immediately after mixing, it is possible to prevent the fuel gas supply pipe 8 and the fuel gas ejection port 9 from being extremely heated.

As described above, the oxygen burner 1 of the present embodiment includes the primary oxygen ejection port 6 provided at the tip of the primary oxygen flow path 5, a plurality of fuel gas supply pipes 8 provided so as to branch the tip end side of the fuel gas flow path 7, the fuel gas ejection port 9 provided in each of the fuel gas supply pipes 8, and the secondary oxygen ejection port 11 provided at a tip of the secondary oxygen flow path 10, the fuel gas ejection ports 9 are arranged so as to surround the primary oxygen ejection port 6, the secondary oxygen ejection port 11 is arranged so as to surround the fuel gas ejection ports 9 and the primary oxygen ejection port 6, and each fuel gas ejection port 9 is arranged on the same plane and protrudes than the tip of the primary oxygen ejection port 6. Therefore, it is possible to form the flame formed by the fuel gas and the secondary oxygen at a position distant from the primary oxygen ejection port 6. As a result, it is possible to form a high-velocity-oxygen jet flow and efficiently dissolve the object to be heated, even though the structure does not require a cooling structure.

Further, according to the operation method for an oxygen burner of the present embodiment, in the oxygen burner 1 described above, since the flow velocity of the primary oxygen ejected from the primary oxygen ejection port 6 is made higher than the flow velocity of the fuel gas ejected from the fuel gas ejection ports 9, it is possible to form a high-velocity-oxygen jet flow and efficiently dissolve the object to be heated while preventing the oxygen burner 1 from being melted and damaged.

Although the embodiments of the present invention have been described above in detail with reference to the drawings, the specific configuration is not limited to this embodiment, and designs and the like within the scope not deviating from the gist of the present invention are included.

In the oxygen burner 1 described above, as shown in FIG. 1, the example in which the fuel gas ejection ports 9 are arranged side by side on a single circle centered on the primary oxygen ejection port 6 has been described, but the arrangement of the fuel gas ejection ports 9 is not limited to this arrangement.

Figure 3A:
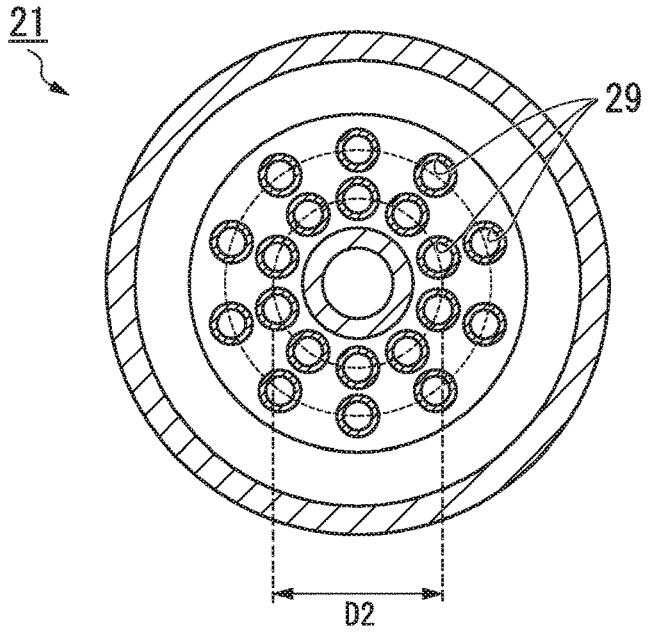
FIG. 3A is a front view showing a tip of an oxygen burner according to another embodiment of the present invention.
Figure 3B:
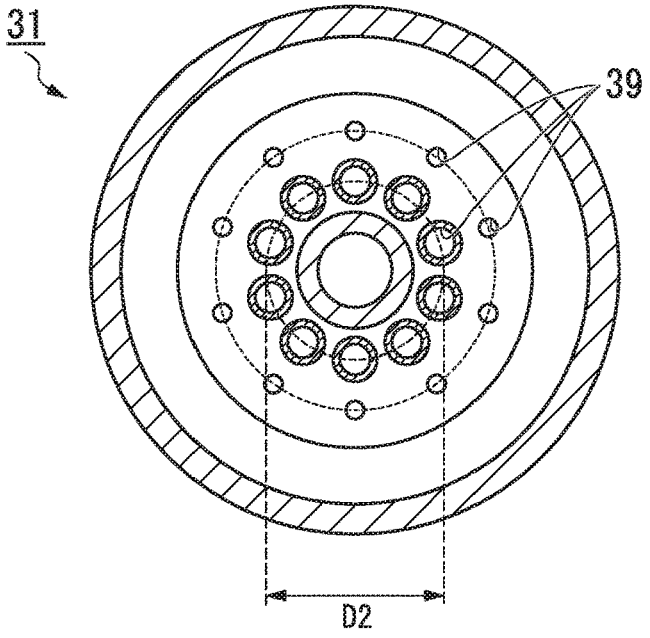
FIG. 3B is a front view showing a tip of an oxygen burner according to another embodiment of the present invention.

For example, as shown in FIG. 3A, the fuel gas ejection ports 29 of the oxygen burner 21 may be arranged side by side on two or more concentric circles centered on the primary oxygen ejection port 6. Further, as shown in FIG. 3B, the size of each fuel gas ejection ports 39 of the oxygen burner 31 may be different.

In the case where the fuel gas ejection ports 29 and 39 are arranged side by side on two or more concentric circles centered on the primary oxygen ejection port 6 like the oxygen burners 21 and 31, D2 can be determined by P.C.D. of the fuel gas ejection ports 29 and 39 which are closer to the primary oxygen ejection port 6.

EXAMPLES

Hereinafter, the effects of the present invention will be described in detail using Example and Comparative Example, but the present invention is not limited to the following Example.

(Dissolution Test)

Dissolution tests were carried out using oxygen burners.

Figure 4:
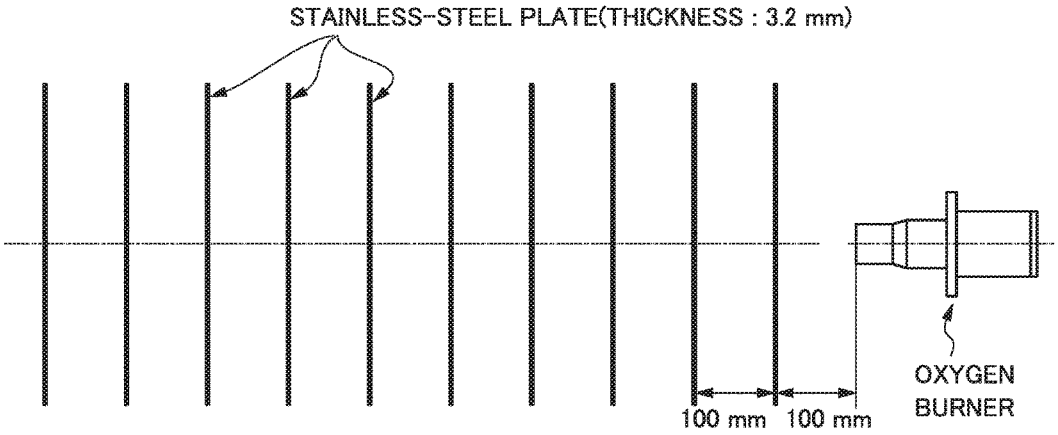
FIG. 4 is a diagram explaining a method of a dissolution test of the oxygen burner.

FIG. 4 is a view showing a method of a dissolution test. As shown in FIG. 4, 10 stainless-steel plates having a thickness of 3.2 mm were placed in parallel at intervals of 100 mm, and the stainless-steel plate was dissolved with an oxygen burner in the dissolution test. The performance of the oxygen burner was evaluated by measuring the distance (penetration distance) from the tip of the oxygen burner to the stainless-steel plate furthest from the oxygen burner among the stainless-steel plate penetrated by the flame of the oxygen burner, and the time (penetration time) required to penetrate the stainless-steel plate.

Example 1

As Example 1, the dissolution test was carried out using the oxygen burner 1 shown in FIGS. 1 and 2. In Example 1, pure oxygen was used as the primary oxygen and the secondary oxygen. City gas was used as the fuel gas. The flow rate of the oxygen ejected from the primary oxygen ejection port was 41 $Nm^3/h$, the flow rate of oxygen ejected from the secondary oxygen ejection port was 42.3 $Nm^3/h$, and the flow rate of the fuel gas ejected from the fuel gas ejection ports was 40 $Nm^3/h$.

The theoretical amount of oxygen required for completely burning 1 $Nm^3$ of city gas is 2.3 $Nm^3$.

Comparative Example 1

Figure 6:
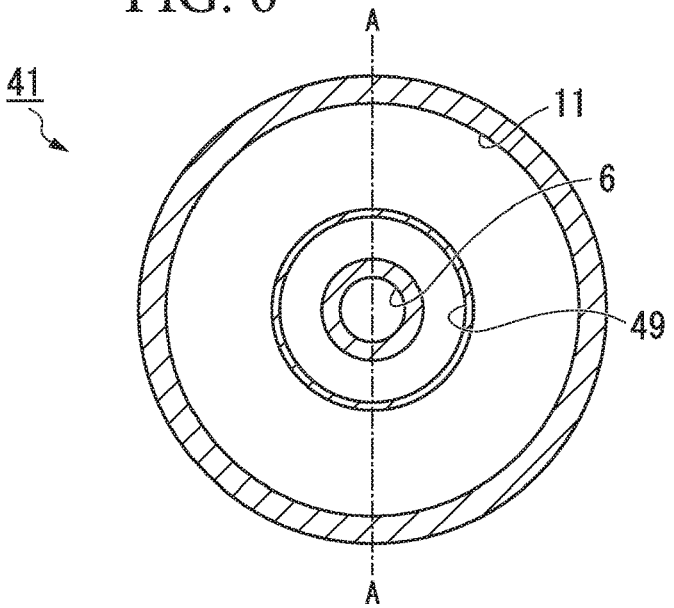
FIG. 6 is a front view showing a tip of a conventional oxygen burner.
Figure 7:
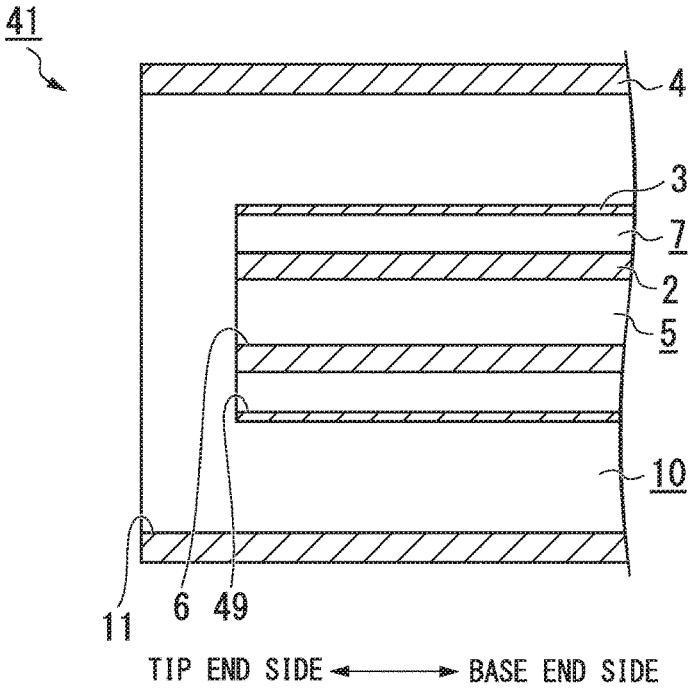
FIG. 7 is a schematic cross-sectional view taken along line A-A of the oxygen burner in FIG. 6.

As Comparative Example 1, the dissolution test was carried out using a conventional oxygen burner. FIGS. 6 and 7 show the structure of the conventional oxygen burner 41 used in Comparative Example 1. As shown in FIG. 7, the conventional oxygen burner 41 does not have the fuel gas supply pipe 8 (see FIG. 2) of the oxygen burner 1 described above. Therefore, as shown in FIG. 6, only one fuel gas ejection port 49 is provided so as to surround the primary oxygen ejection port 6 in the conventional oxygen burner 41.

In Comparative Example 1, oxygen was used as the primary oxygen and the secondary oxygen. City gas was used as the fuel gas. The flow rate of the oxygen ejected from the primary oxygen ejection port was 41 $Nm^3/h$, the flow rate of the oxygen ejected from the secondary oxygen ejection port was 42.3 $Nm^3/h$, and the flow rate of the fuel gas ejected from the fuel gas ejection ports was 40 $Nm^3/h$.

Figure 5:
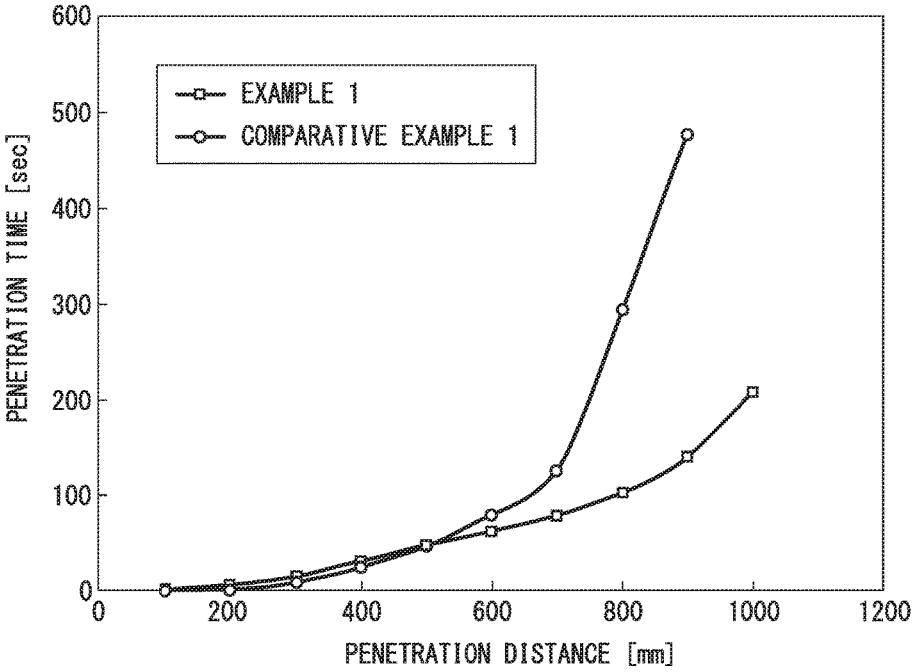
FIG. 5 is a graph showing the results of the dissolution test of the oxygen burner.

The results of the dissolution test are shown in FIG. 5.

As shown in FIG. 5, it was possible to dissolve and penetrate the stainless-steel plates (10th plate) at a distance of 1.000 mm from the tip of the oxygen burner in Example 1. On the other hand, only stainless-steel plates (ninth sheet) at a distance of 900 mm could be dissolved in Comparative Example 1.

In addition, the time required to dissolve (penetrate) the stainless-steel plates (ninth plate) at a distance of 900 mm was shorter in Example 1 than the time required to dissolve (penetrate) the stainless-steel plates (ninth plate) at a distance of 900 mm in Comparative Example 1. In Example 1, penetration was possible in ⅓ of the time of Comparative Example 1.

In addition, when the conditions of the primary oxygen ejection port of the oxygen burner were confirmed after the dissolution test, it was confirmed that although the oxygen burner used in Example 1 was improved in dissolution performance as compared with the oxygen burner used in Comparative Example 1, the oxygen burner was not melted and damaged.

INDUSTRIAL APPLICABILITY

The oxygen burner and the operation method for an oxygen burner according to the present invention have a possibility of being used for an oxygen burner and an operation method for an oxygen burner suitable for heating and melting an object to be heated such as glass and iron scrap.

DESCRIPTION OF SYMBOLS

1, 21, 31, 41 oxygen burner
2 center pipe

3 inner pipe
4 outer pipe
5 primary oxygen flow path
6 primary oxygen ejection port
7 fuel gas flow path
8 fuel gas supply pipe
9, 29, 39, 49 fuel gas ejection port
10 secondary oxygen flow path
11 secondary oxygen ejection port

The invention claimed is:

1. An oxygen burner having a triple pipe structure in which a center pipe, an inner pipe on an outer side of the center pipe, and an outer pipe on an outer side of the inner pipe are concentrically arranged, and comprising a primary oxygen flow path formed inside the center pipe, a fuel gas flow path formed between the center pipe and the inner pipe, and a secondary flow path formed between the inner pipe and the outer pipe, wherein the oxygen burner comprises a primary oxygen ejection port provided at a tip of the primary oxygen flow path, a plurality of fuel gas supply pipes provided so as to branch a tip end side of the fuel gas flow path, a fuel gas ejection port provided in each of the fuel gas supply pipes, and a secondary oxygen ejection port provided at a tip of the secondary oxygen flow path, the fuel gas ejecting ports are arranged so as to surround the primary oxygen ejection port, the secondary oxygen ejection port is arranged so as to surround the fuel gas ejection ports and the primary oxygen ejection port, and the fuel gas ejection ports are arranged on the same plane and protrude than a tip of the primary oxygen ejection port.

2. An operation method for an oxygen burner, wherein the flow velocity of the primary oxygen ejected from the primary oxygen ejection port is higher than the flow velocity of the fuel gas ejected from the fuel gas ejection ports in the oxygen burner according to claim 1.

3. The operation method for an oxygen burner according to claim 2, wherein the flow velocity of the fuel gas ejected from the fuel gas ejection ports is higher than the flow velocity of the secondary oxygen ejected from the secondary oxygen ejection port.

4. The operation method for an oxygen burner according to claim 2, wherein a relationship between an oxygen flow rate A ejected from the primary oxygen ejection port, an oxygen flow rate B ejected from the secondary oxygen ejection port, and an oxygen flow rate C which is necessary for completely burning the fuel gas ejected from the fuel gas ejection ports is represented by the following formula (1):

$$C/(A+B) \leq 1 \quad (1).$$

5. The operation method for an oxygen burner according to claim 3, wherein a relationship between an oxygen flow rate A ejected from the primary oxygen ejection port, an oxygen flow rate B ejected from the secondary oxygen ejection port, and an oxygen flow rate C which is necessary for completely burning the fuel gas ejected from the fuel gas ejection ports is represented by the following formula (1):

$$C/(A+B) \leq 1 \quad (1).$$

* * * * *